US005188158A

United States Patent [19]

Gstettner et al.

[11] Patent Number: 5,188,158

[45] Date of Patent: Feb. 23, 1993

[54] EXCHANGEABLE ELEMENT SUBJECT TO WEAR

[75] Inventors: Manfred Gstettner, Bohlerwerk; Alois Wimmer, Rosenau, both of Austria

[73] Assignee: Böhler Ybbstalwerke GmbH, Böhlerwerk, Austria

[21] Appl. No.: 777,141

[22] Filed: Oct. 16, 1991

[30] Foreign Application Priority Data

Oct. 17, 1990 [AT] Austria ..... 2091/90

[51] Int. Cl.[5] ..... B27C 1/00; B02C 17/14

[52] U.S. Cl. ..... 144/162 R; 144/172; 144/176; 241/183

[58] Field of Search ..... 144/2 R, 162 R, 172, 144/173, 174, 176; 241/183

[56] References Cited

U.S. PATENT DOCUMENTS 3,186,650 6/1965 Dixon et al. ..... 241/183

*Primary Examiner*—W. Donald Bray

*Attorney, Agent, or Firm*—Sandler, Greenblum & Bernstein

[57] ABSTRACT

The exchangeable wear-resistant element serves to protect structural parts against abrasive wear. This exchangeable wear-resistant element comprises a base part formed of a tough material and a support part formed of a material possessing high wear resistance. The base part and the support part are interconnected at confronting faces or surfaces and the base part is provided with an attachment element.

22 Claims, 2 Drawing Sheets

EXCHANGEABLE ELEMENT SUBJECT TO WEAR

BACKGROUND OF THE INVENTION

1. Field of the Invention

The present invention relates to a new and improved exchangeable element subject to wear—also sometimes referred to herein as an exchangeable wear-resistant element—, especially wear-resistant plates or wear-resistant shoes or liners, for the protection of structural parts against abrasive wear. Such exchangeable elements which are subject to wear are particularly, although not exclusively used, in machines, such as, for example, wood working machines and wood chipping or comminution machines and the like, or for the at least partial armoring or lining of walls which are subject to abrasive wear.

2. Discussion of the Background and Material Information

Wear-resistant elements or armor-plating or linings and the like when employed in conjunction with structural and machine parts exposed to abrasive loads or burdens, serve the purpose of preventing or reducing as far as possible the abrasive removal of material, in order that there can be increased the service life of such parts and/or to increase their operational reliability. Frequently wear-resistant elements are installed in machines in order to counteract alteration of the geometrical conditions arising due to removal of material at the relevant parts and which otherwise would have a deleterious effect upon the operation of the machine. Armoring or lining of a part can be accomplished in a simple manner by repeatedly welding wear-resistant supplementary weld materials upon the structural- or machine part. However, that procedure is associated with the drawback that due to the application of heat to the structural- or machine part distortion or warping of the part can occur and there is then usually required a complicated post-machining operation for smoothing the surface of such undesirably modified part.

It is known in this technology to fabricate exchangeable elements subject to wear or wear-resistant elements from materials exhibiting high resistance against abrasive-removal of such material. Such hard or hardened materials are usually quite brittle, so that there exists a considerable danger of fracturing or rupturing the wear-resistant element, especially when such wear-resistant element is exposed to a surge-like load or burden. Additionally, these materials either can not be welded or are insufficiently weldable, so that the attachment of the wear-resistant element is usually perfected by attachment elements in the form of throughpassing bolts or screws, resulting in a further weakening of the strength of the wear-resistant element. During actual operating conditions there possibly arise a removal of material of the attachment elements at their end faces and a cratering or erosion of the wear-resistant part at neighboring regions of the receiving bores or holes for the associated bolts or screws. Apart from the foregoing, the stability of the attachment is frequently insufficient.

SUMMARY OF THE INVENTION

Therefore, with the foregoing in mind, it is a primary object of the present invention to provide an improved element subject to wear which is not afflicted with the aforementioned limitations and shortcomings of the prior art.

Another and more specific object of the present invention aims at providing an improved wear-resistant element of the previously mentioned type possessing increased wear-resistance and service life or longevity, relatively little danger of fracturing and which can be fastened simply and with considerable stability.

Still a further noteworthy object of the present invention concerns the provision of an improved wear-resistant 15 element possessing the properties set forth in the immediately preceding object and which can be produced in a relatively simple, reliable and economical manner.

Now in order to implement these and still further objects of the present invention, which will become more readily apparent as the description proceeds, the wear-resistant element of the present development is manifested, among other things, by the features that such wear-resistant element comprises a base part formed of a tough, such as a good weldable structural steel, material and a support part formed of a material possessing high wear resistance. The base part and the support part are interconnected at respective confronting faces defining a connection surface in interface relationship, that is, in surface-to-surface contacting relationship to one another at an interface between the base part and the support part. The base part is provided with an attachment or fastening element for the releasable connection of the wear-resistant element with a structural part or the like.

According to a further aspect of the present invention, the connection surface at the interface between the base part and the support part extends substantially parallel to an outer surface of the support part which is exposed to wear.

Still further, the surface-to-surface interface or connection surface between the base part and the support part can comprise a metallic or metallurgical bond or solder connection.

According to a further feature, it is contemplated that the body or body member composed of the base part and the support part comprises a composite or compound material.

Furthermore, the outer surface of the support part which is exposed to wear is advantageously devoid of openings, tapped or threaded holes or the like.

Also the support part may comprise a wear-resistant alloy which is weld-connected thereto.

With reference to a further feature of the present invention, the wear-resistant element, especially the support part, is heat-treated, for example, tempered or hardened.

The attachment or fastening element is advantageously fixedly or non-releasably connected with the base part, especially by means of a weld connection.

Furthermore, the diameter of the attachment or fastening element can be increased at the region of the fixed connection with the base part.

Still further, the base part possesses, at least at the region of the fixed or non-releasable connection with the attachment or fastening element, a recess or depression or the like filled with a suitable connection or securing means, for example, weld material or a weld supplementary material or solder.

It is further envisioned to have the thickness of the support part equal to or less than the maximum thickness of the base part.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the wear-resistant element and the related structure have been depicted therein, in order to simplify the illustration, as needed for those skilled in the art to readily understand the underlying principles and concepts of the present invention.

Figure 1:
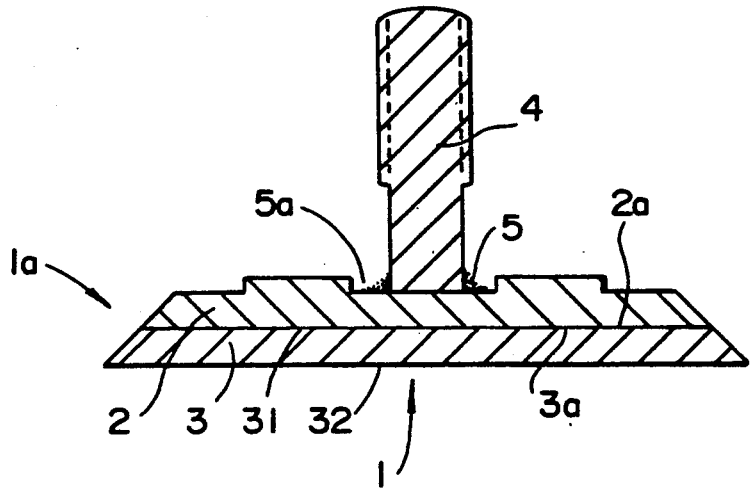
FIG. 1 is a cross-sectional view through a wear-resistant element constructed according to the present invention.

With reference now to the exemplary embodiment of wear-resistant element 1 shown in FIG. 1, such will be seen to comprise a substantially plate-shaped element 1*a* provided with an attachment or fastening means or element 4. This substantially plate-shaped element 1*a* comprises a support part 3 formed of a wear-resistant material, specifically, a tool steel, for example, DIN-tool steel No. 1.2080 containing 1.9 percent-by-weight to 2.20 percent-by-weight carbon and 11.0 percent-by-weight to 12.0 percent-by-weight chromium, which substantially corresponds to AISI-Type D3, and a base part 2 formed of good weldable structural steel. The substantially plate-shaped element 1*a* is machined out of a composite or compound material, for example, composite steel plating. The two plates or sheet metal plating, composed of two material parts defining a body member and which are metallurgically connected or bonded with one another, have a thickness of about 12 millimeters and are fabricated, for example, by rolling welding. A thermal treatment or hardening is undertaken with the view of achieving maximum wear resistance and hardness of the support part 3.

The securement of the attachment or fastening element 4 is accomplished by, for example, arc welding or butt welding while forming a weld seam, here a weld bead or securing-material connection 5. It has been surprisingly found that notwithstanding the application of heat to the base part 2 during the weld-connection of the attachment or fastening element 4 thereat, there were not detected any tempering or annealing effects or local hardness loss of the material of the support part 3. Moreover, it was further found that during use of the wear-resistant element in actual practice over a longer period of time, there occurred a uniform wear of the wearable surface 32 of the support part 3 there existed a high security against fracture of the wear-resistant element 1, even when such wear-resistant element 1 was exposed to impact loads at one side, and the insertion or mounting of the wear-resistant element 1 remained fixed in place and stable.

Furthermore, it will be seen that the base part 2 is provided with a recess or depression 5*a* at the region where there is connected the attachment or fastening element 4 and which can be at least partially filled with a suitable securing or connection means, such as a suitable weld material or solder, as generally indicated by reference numeral 5. Additionally, it will be observed that the confronting faces 2*a* and 3*a* of the base 15 part 2 and the support part 3, respectively, are appropriately interconnected at the intermediate connection surface 31 located at the interface between the base part 2 and the support part 3. This connection surface 31 is shown to extend substantially parallel to the surface 32 of the support part 3 which is subject to wear.

Figure 1A:
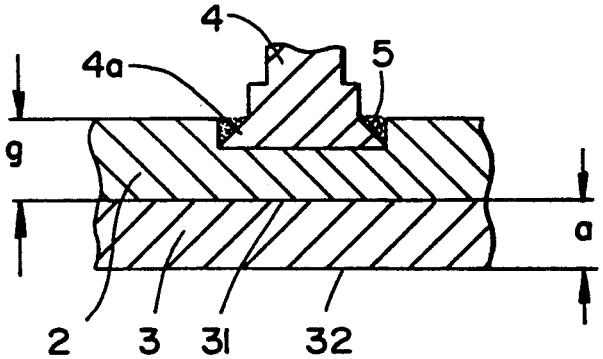
FIG. 1*a* is a fragmentary cross-sectional view of the wear-resistant element of FIG. 1, depicting details concerning the connection of the attachment or fastening element.

As shown in FIG. 1*a*, it is also possible for the attachment or fastening element 4 to be increased in size or have a larger diameter, that is, to have an enlarged portion 4*a*, at the region of its connection 5 with the base part 2. Such measure is then particularly advantageous if there additionally arise increased bending loads. Particularly good stability and service life characteristics of the wear-resistant element 1 can be then attained when the thickness g of the base part 2 is equal to or greater than the thickness a of the support part 3. It is also possible, for example, to form the support part 3 of carbides or hard metals and to fixedly connect such support part 3 by soldering or the like with the base part 2. Furthermore, the support part 3 can be produced by weld-deposit coating of the base part 2.

Figure 2:
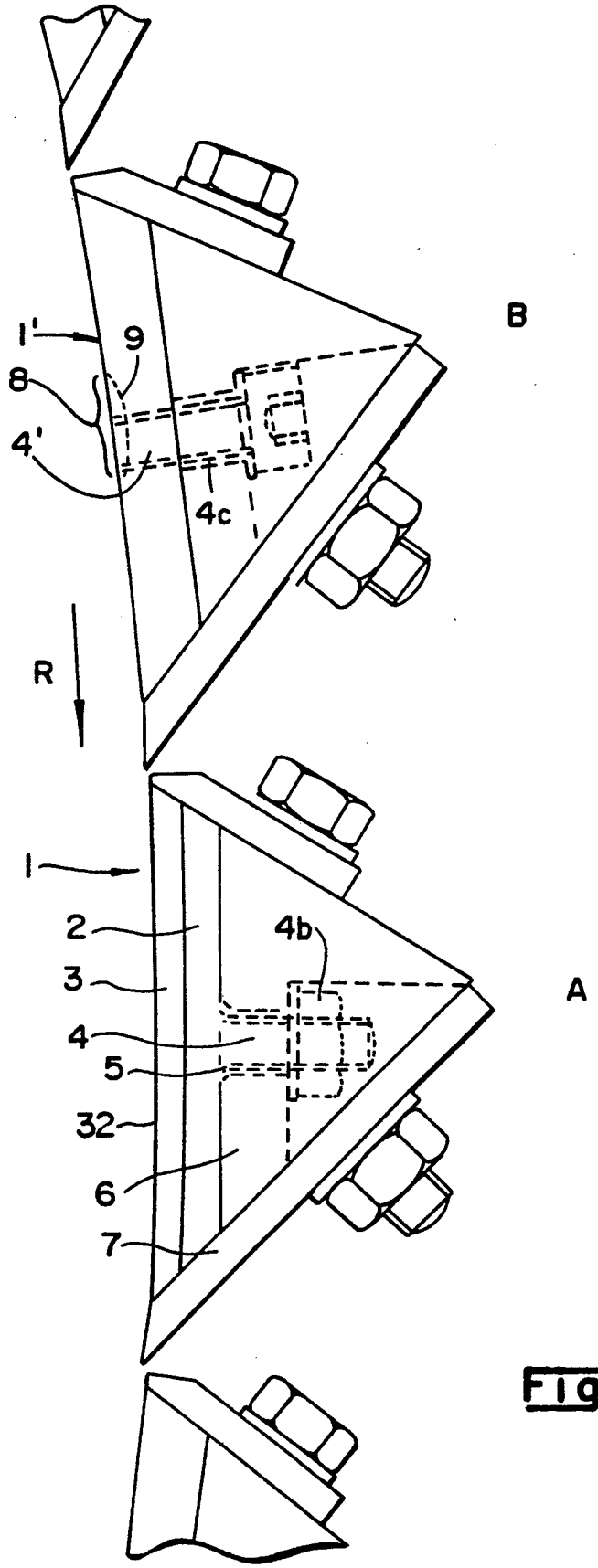
FIG. 2 depicts a wear-resistant part constructed according to the present invention and appearing at location or region A of such FIG. 2 and a further depicting a conventional wear-resistant part of the prior art appearing at location or region B, both arranged in a machine, here, for instance, a wood cutting or chipping apparatus.

FIG. 2 illustrates a wear-resistant element at location A which has been constructed according to the present invention and at location B a conventional or prior art constructed wear-resistant element 1', both of which have been installed in a structural part, here a rotating ring or ring part 6 of a material-removal or cutting apparatus, for example a wood working, that is, a cutting or chipping machine or apparatus. This ring or ring part 6 which is equipped with the cutters or knifes 7, rotates in the direction of the arrow R, and the wooden parts or articles to be cut are moved in the opposite direction. The inventive wear-resistant element 1, located at location or region A, during the fabrication of chipped wooden pieces exhibited a slight uniform wear of the surface 32 of the support part 3. The attachment of the wear-resistant element 1 at the structural part, here the ring or ring part 6 by means of the attachment or fastening element 4 and a nut member 4*b*, remained stable and maintenance-free even during continuous operation. As previously explained, at the location or region B there is shown a conventional wear-resistant element 1', having a threaded bore or tapped hole 4*c* and secured to the ring part 6 by means of a screw or threaded bolt 4'. In the presence of abrasive loads a pronounced abrading or removal of material takes place at the location where the screw or threaded bolt 4' piercingly extends through the threaded bore or tapped hole 4*c* and additionally there occurred a local cratering or erosion 9 of the wear-resistant element 1. Furthermore, there also can possibly occur, especially in the presence of an irregular pronounced load, loosening of the screw or bolt connection and/or release of such screw or bolt connection, and thus there can be required repeated tightening of the screw of threaded bolt 4' or an exchange of the wear-resistant element 1'.

While there are shown and described present preferred embodiments of the invention, it is distinctly to be understood the invention is not limited thereto, but may be otherwise variously embodied and practiced within the scope of the following claims.

What is claimed is:

1. An exchangeable wear-resistant element for the protection of a structural part against abrasive wear, comprising:
a base part formed of a tough material;
a support part formed of a material possessing high wear resistance;
the base part having a connection face;
the support part having a connection face;
the connection face of the base part and the connection face of the support part confronting one another at an interface between the base part and the support part and being interconnected to define a connection surface;
an attachment element provided for the base part; and
the attachment element serving for the releasable connection of the wear-resistant element with a structural part.

2. The exchangeable wear-resistant element according to claim 1, wherein:
the structural part comprises a part of a machine.

3. The exchangeable wear-resistant element according to claim 2, wherein:
the machine comprises a wood working machine.

4. The exchangeable wear-resistant element according to claim 1, wherein:
the support part has an outer surface which is exposed to wear; and
the connection surface at the interface between the base part and the support part extends substantially parallel to the outer surface of the support part which is exposed to wear.

5. The exchangeable wear-resistant element according to claim 1, wherein:
the connection surface between the base part and the support part comprises a metallurgical bond.

6. The exchangeable wear-resistant element according to claim 1, wherein:
the connection surface between the base part and the support part comprises a solder connection.

7. The exchangeable wear-resistant element according to claim 1, wherein:
the base part and the support part define a body member; and
the body member comprises a composite material.

8. The exchangeable wear-resistant element according to claim 1, wherein:
the support part has an outer surface which is exposed to wear; and
the outer surface of the support part which is exposed to wear is devoid of openings.

9. The exchangeable wear-resistant element according to claim 1, wherein:
the support part has an outer surface which is exposed to wear; and
the outer surface of the support part which is exposed to wear is devoid of tapped holes.

10. The exchangeable wear-resistant element according to claim 1, wherein:
the support part comprises a wear-resistant alloy which is weld-connected thereto.

11. The exchangeable wear-resistant element according to claim 1, wherein:
the support part comprises a heat-treated support part.

12. The exchangeable wear-resistant element according to claim 11, wherein:
the heat-treated support part comprises a tempered support part.

13. The exchangeable wear-resistant element according to claim 11, wherein:
the heat-treated support part comprises a hardened support part.

14. The exchangeable wear-resistant element according to claim 1, further including:
means for fixedly connecting the attachment element with the base part.

15. The exchangeable wear-resistant element according to claim 14, wherein:
the means for fixedly connecting the attachment element with the base part comprises a weld connection.

16. The exchangeable wear-resistant element according to claim 14, wherein:
the attachment element has an enlarged portion at the region of the fixed connection with the base part.

17. The exchangeable wear-resistant element according to claim 14, wherein:
the base part possesses, at least at the region of the fixed connection with the attachment element, a recess filled with a securing means.

18. The exchangeable wear-resistant element according to claim 17, wherein:
the securing means comprises weld material.

19. The exchangeable wear-resistant element according to claim 17, wherein:
the securing means comprises solder.

20. The exchangeable wear-resistant element according to claim 1, wherein:
the base part has a maximum thickness; and
the support part has a thickness substantially equal to the maximum thickness of the base part.

21. The exchangeable wear-resistant element according to claim 1, wherein:
the base part has a maximum thickness; and
the support part has a thickness less than the maximum thickness of the base part.

22. The exchangeable wear-resistant element according to claim 1, wherein said base part is formed of a good weldable structural steel.

* * * * *